United States Patent [19]

Knapp et al.

[11] Patent Number: 4,713,575

[45] Date of Patent: Dec. 15, 1987

[54] METHOD OF MAKING A COLOR SELECTION DEFLECTION STRUCTURE, AND A COLOR PICTURE DISPLAY TUBE INCLUDING A COLOR SELECTION DEFLECTION STRUCTURE MADE BY THE METHOD

[75] Inventors: Alan G. Knapp, Crawley; Colin D. Overall, Reigate; Richard A. M. Slater, Copthorne, all of England

[73] Assignee: U.S. Philips Corporation, New York, N.Y.

[21] Appl. No.: 911,849

[22] Filed: Sep. 26, 1986

[30] Foreign Application Priority Data

Oct. 21, 1985 [GB] United Kingdom ..... 8525905

[51] Int. Cl.[4] ..... H01J 31/48; H01J 9/12

[52] U.S. Cl. ..... 313/400; 445/36

[58] Field of Search ..... 445/36, 37, 49, 50; 313/399, 400, 401

[56] References Cited

U.S. PATENT DOCUMENTS

| | | | |
|---|---|---|---|
| 3,253,182 | 5/1966 | Marchet | 445/49 X |
| 4,107,569 | 8/1978 | Ronde | 313/402 |
| 4,121,131 | 10/1978 | van Esdonk et al. | 445/37 X |
| 4,560,898 | 12/1985 | Knapp et al. | 313/400 |

FOREIGN PATENT DOCUMENTS

| | | |
|---|---|---|
| 1434053 | 4/1976 | United Kingdom . |
| 2023332 | 12/1979 | United Kingdom . |
| 2101396 | 1/1983 | United Kingdom . |
| 2124017 | 2/1984 | United Kingdom . |

*Primary Examiner*—Kenneth J. Ramsey
*Attorney, Agent, or Firm*—John C. Fox

[57] ABSTRACT

The invention relates to methods of making color selection deflection electrode structures for use in color picture display tubes having a channel plate electron multiplier arranged adjacent a screen, the deflection electrode structure being disposed intermediate the multiplier and screen and consisting of pairs of elongate, rectangular electrodes aligned with rows of output apertures of the multiplier and operable to control the direction of an electron beam emanating from those apertures so as to impinge upon a selected one of a plurality of different color phosphors in repeating pattern comprising the screen. The methods involve the steps of forming slits (1) in a pair of thin metal sheets, e.g. by etching, to define the required deflection electrodes (3) together with margins (7, 8) and interconnecting supporting strips (4, 5), bonding the two sheets together using an insulative bonding glass material with respective electrodes thereof in registration to form an integral assembly, and rotating the electrodes (3) through around 90° with respect to the plane of the sheets. Spacing elements determine spacing between opposed electrodes and margins.

13 Claims, 17 Drawing Figures

METHOD OF MAKING A COLOR SELECTION DEFLECTION STRUCTURE, AND A COLOR PICTURE DISPLAY TUBE INCLUDING A COLOR SELECTION DEFLECTION STRUCTURE MADE BY THE METHOD

BACKGROUND OF THE INVENTION

The invention relates to a method of making a colour selection deflection structure for a colour picture display tube comprising a channel plate electron multiplier provided with an extractor electrode mounted on and electrically insulated from the output face of the electron multiplier. The invention also relates to a colour picture display tube which includes a colour selection deflection electrode structure manufactured by such a method.

Colour picture display tubes have been proposed which include a laminated dynode channel plate electron multiplier provided with an apertured extractor electrode mounted on and electrically insulated from the output face of an electron multiplier and use a single electron gun to produce colour pictures. It has been found possible both to improve the colour quality of the pictures and to make corrections for small misalignments between the channel plate electron multiplier and the phosphor patterns on the display screen. This has been achieved by providing the tube with a colour selection deflection structure in which pairs of deflection electrodes are disposed between columns of apertures in an extractor electrode provided on the output side of the channel plate multiplier. Specification GB-A-2,124,017 discloses such a picture tube which comprises a laminated dynode channel plate electron multiplier, means for generating an electron beam to be scanned across an input face of the electron multiplier, an apertured extractor electrode mounted on and electrically insulated from an output face of the electron multiplier, apertures in the extractor electrode communicating with respective channels in the electron multiplier, a luminescent screen spaced from the extractor electrode, the screen comprising a repeating pattern of phosphor elements adapted to luminesce in different colours, each pattern comprising one of each type of phosphor only and, between apertures of the extractor electrode, pairs of first and second deflector electrodes electrically insulated from each other and the extractor electrode, the first electrodes of each pair being coupled together and the second electrodes of each pair being coupled together, wherein the apertures in the extractor electrode are arranged rectilinearly and a pair of first and second electrodes is disposed between adjacent lines of the apertures. The use of pairs of first and second deflector electrodes between adjacent lines of apertures in the extractor electrode enables electrical corrections to be made for static misalignment errors.

Specification GB-A-2,124,017 describes a method of making the deflection electrode structure, in which method elongate slots are etched in a plate of FOTOFORM (Registered Trade Mark) glass which is electrically insulating, between margins of the plate. The width of the slots corresponded substantially to the distance between the facing surfaces of a pair of deflector electrodes arranged one on each side of a row of apertures in the extractor electrode. Electrically conductive material is then evaporated onto one main surface of the etched plate and down onto the sidewalls of the slots. The electrically conductive material is present on areas of the main surfaces of the plate and on the sidewalls. Where it is not required it is subsequently removed to leave the desired electrode structure. Care is taken to ensure both that all the electrode elements of each respective set remain interconnected and to avoid short circuits between electrode elements of the two sets or between an electrode element of one set and an interconnecting strip of the other set.

An object of the invention is to provide a cheap and simple method of making a colour selection deflection structure for a colour picture display tube which includes a channel plate electron multiplier. Another object of the invention is to provide a colour display picture tube with a colour selection deflection structure which is electrically robust, so that, for example, there would be no failure of this structure in the event of a flashover.

SUMMARY OF THE INVENTION

The invention provides a method of making a colour-selection deflection structure for a colour picture display tube which includes a channel plate electron multiplier provided with an extractor electrode mounted on and electrically insulated from the output face of the electron multiplier, the method comprising the steps of forming a plurality of parallel slits in each of a pair of metal sheets, each slit extending between opposite margins of the respective sheet, wherein each pair of adjacent slits in a respective metal sheet defines an elongate rectangular deflector electrode and strip portions which extend one from each end to the adjacent margin of the metal sheet, applying a glass to at least one of the metal sheets on a major surface of the deflector electrodes and of the margins of the metal sheet, heating the metal sheet(s) bearing the glass so as to produce an adherent coating of glass on the deflector electrodes and sheet margins, rotating the deflector electrodes on each sheet through 90±5° about axes parallel to, and offset from, the longitudinal axis of the respective deflector electrode, juxtaposing the two sheets so that the deflector electrodes of one sheet are in registration with the deflector electrodes of the other metal sheet, forming an integral assembly by heating the pair of juxtaposed metal sheets so as to soften the glass and urging the registered pairs of deflector electrodes and opposed sheet margins respectively towards each other, wherein the spacing between the opposed deflector electrodes and between the opposed sheet margins is determined by spacing elements provided between the said deflector electrodes and between the said sheet margins, wherein the spacer elements have a softening point above the temperature to which the juxtaposed metal sheets were heated during the formation of the integral assembly. An advanvage of this method of making a deflector electrode structure is that the electrode elements of a respective set are formed from one metal sheet and so are automatically interconnected. The slits are preferably formed by etching. The metal sheets may consist, for example, of mild steel which is from 0.05 to 0.2 mm thick.

In one embodiment of the invention, a first metal sheet provided with the slits is superposed on a second metal sheet provided with the slits, the deflector electrodes of the two sheets being in registration and being separated only by spacer elements disposed between the opposed deflector electrodes and between the opposed sheet margins and the glass coating(s), the opposed deflector electrodes and the opposed sheet margins are respectively bonded together by heating the pair of metal sheets so as to soften the glass and urging the two metal sheets towards each other until the separation between the opposed deflector electrodes and between the opposed sheet margins is determined by the spacing elements, the assembly is cooled, and the pairs of deflector electrodes are rotated through 90±5° about respective axes which are parallel to and offset from the longitudinal axes of the respective pair of deflector electrodes.

In another embodiment of the invention, the rigidity of the metal sheets until these sheets have been bonded together is improved by interrupting the slits of the sheets by tie bars which interconnect adjacent deflector electrodes, and the tie bars are removed after the opposed deflector electrodes and the opposed sheet margin have been bonded together and before the pairs of deflector electrodes have been rotated. The tie bars may be removed, for example, by etching, by laser cutting, or by abrasive air blasting.

In another method according to the invention, the deflector electrodes and strip portions are not defined in the metal sheets until after a sandwich has been formed consisting of the metal sheets separated by spacing elements and adherent glass coatings. In one embodiment of this method of the invention the colour-selection deflection structure is made by a method comprising the steps of providing one main surface of at least one of a pair of metal sheets with an adhered glass coating in a pattern corresponding substantially to the positions of a plurality of parallel rectangular elongate deflector electrodes connected to margins of the sheet by strip portions, which deflector electrodes and strip portions are subsequently to be produced by selectively etching that metal sheet, assembling the pair of metal sheets to form a sandwich in which the glass coating and spacing elements are disposed between the metal sheets, heating the sandwich so as to soften the glass coating and urging the metal sheets towards each other so as to form a unitary assembly in which the distance between the metal sheets is defined by the spacing elements, providing photoresist masks on the two metal sheets, the apertures in which masks define the deflector electrodes and the strip portions to be formed in each metal sheet, the masks being disposed so that the deflector electrodes of one metal sheet are in registration with the deflector electrodes of the other metal sheet, etching the metal sheets through the masks so as to produce the deflector electrodes and strip portions, and rotating each pair of opposed deflector electrodes through 90±5° about a respective axis which is parallel to and offset from the longitudinal axes of the respective pair of deflector electrodes. In another embodiment, the patterned adherent glass coating is formed on each metal sheet by etching a pattern of channels which correspond to the positions of the deflector electrodes and of the margins of the sheet in one main surface of each metal sheet, filling the channels with glass by applying glass powder to the etched main surface of each metal sheet, removing the glass powder standing proud of the channels and also the glass powder present on the unetched areas of the main surface of each metal sheet, and heating each metal sheet so as to form the adherent patterned glass coating on the respective metal sheet. In another embodiment, one main surface of each metal sheet is preetched through more than 50% of their thickness in accordance with a pattern which defines the outlines of deflection electrodes and the strip portions, and then the adherent glass coating is formed on the other main surface of one or both of the metal sheets.

In another embodiment, each elongate rectangular deflector electrode is supported at its ends by respective first and second strip portions of the metal sheet, wherein first ends of the respective strip portions merge one each into the respective ends of the deflector electrode and are situated between the longitudinal axis of the deflector electrode and a first border of the sheet, and the second ends of the strip portions merge into respective opposite margins of the metal sheet, wherein the said first and second strip portions are substantially symmetrically disposed with respect to the deflector electrode longitudinal axis, and wherein the first end of one metal sheet of the superposed pair is remote from the said first end of the other metal sheet. When using this embodiment of the invention, rotation of the pairs of deflector electrodes may be commenced by increasing the separation in the planes of the metal sheets between the margins of the metal sheets which merge with the strip portions.

The spacing elements may be, for example, glass fibres or ballotini. Glass fibres have the advantage that long lengths having accurately controlled diameters can be made very readily.

Mild steel sheets can be etched readily and it is preferred to use sheets which are from 0.05 to 0.2 mm thick.

The present invention also provides a colour picture display tube comprising an envelope having an optically transparent faceplate, a cathodoluminescent screen contiguous with the internal surface of the faceplate, an apertured channel plate electron multiplier mounted adjacent to, but spaced from, the screen, an extractor electrode mounted on, and insulated from, an output face of the electron multiplier, a colour selection deflection structure mounted over, and insulated from, the extractor electrode, said structure comprising pairs of opposed electrodes, said deflector electrodes being insulated from each other by spacer elements, the pairs of opposed deflector electrodes comprising contiguous strip portions of juxtaposed metal sheets which are separated from each other by the spacer elements, which strip portions have been rotated about their ends so as to be at 90°±5° to the plane of their respective sheets.

BRIEF DESCRIPTION OF THE DRAWINGS

Some embodiments of the invention will now be described with reference to the following Examples and to the diagrammatic drawings, in which.

In the drawings corresponding reference numerals have been used to indicate similar features shown in the drawings.

DESCRIPTION OF THE PREFERRED EMBODIMENT

EXAMPLE 1

Figure 1:
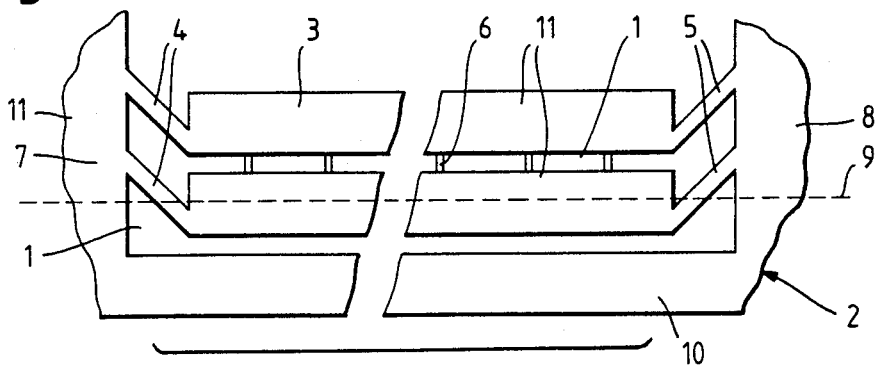
FIG. 1 is a plan view of part of a metal sheet in which deflector electrodes and strip portions have been produced by etching.

Two 75 μm thick mild steel sheets (250 mm×200 mm) were degreased and both main surfaces of each sheet were coated with a layer of a positive-working photoresists. Two different masks were used to define patterns in the photoresist layers by exposing the layers, and subsequently developing the exposed layers. The apertures in one of the masks corresponded to slits 1 formed in a steel sheet 2 (FIG. 1), which slits 1 define deflector electrodes 3 and strip portions 4 and 5 which support the deflector electrodes 3. The slits 1 were interrupted at 15 mm intervals by tie-bars 6 which were 500 μm wide. These tie-bars 6 strengthened the etched sheets and made it unnecessary to hold the etched sheets in tensioning frames. The apertures in the other mask corresponded to slits 1 which had no interruptions between opposite margins 7 and 8 of the sheet 2. The two patterns were formed on the sheet so that the respective sets of slits were coincident. The slits 1 were then etched in the sheets 2 by spray-etching from both sides of the sheets 2 simultaneously using a ferric chloride solution. Since the areas of the tie-bars 6 were only etched from one side, the thickness of the tie-bars remaining after etching of the slits had been completed was approximately 30 μm. First ends of the strip portions 4 and 5 merge one each into respective ends of a deflector electrode 3 and are situated between the longitudinal axis 9 of the deflector electrode 3 and a first border 10 of the sheet 2. The second ends of the strip portions 4 and 5 merge into respective opposite margins 7 and 8 of the sheet 2 and are disposed on the side of the deflector electrode longitudinal axis 9 remote from the sheet border 10. It has been found that very satisfactory results are achieved also when those second ends merge into respective opposite margins 7 and 8 of the sheet 2 and are disposed on the side of the electrode axis 9 nearer to the border 10. In this case the strip portions 4 and 5 are preferably inclined slightly with respect to the axis 9 (e.g. around 20°) although they may even extend parallel to that axis.

After etching had been completed, the residual photoresist layers were removed from the steel sheets 2, and the main surface of each etched sheet from which the tie-bar 6 areas had been etched was sprayed with a suspension of glass particles over the entire surface except the strip portions 4 and 5. The glass may alternatively be deposited in the form of a glass ink by screen printing. When the suspension (or ink) had dried, the sheets 2 were heated so as to convert the glass particles into adherent glass coatings 11. Two sheets 2 were then assembled to form a bonded sandwich with 60 μm electrically insulative ballotini 12 disposed between the opposed glass coatings 11, while the deflector electrodes 3 of the two sheets were in mutual registration. The first borders 10 (only one of which is shown in FIG. 1) of the two sheets 2 were situated at opposite ends of the sandwich and were opposed to respective second borders (not shown). The sandwich was heated to 490° C. in order to soften the glass coatings 11 while the steel sheets 2 were urged towards each other until the spacing between the sheets 2 was determined by the ballotini 12, which had a softening-point of 600° C. Upon cooling, the two sheets were bonded together by the glass coatings.

Figure 4:
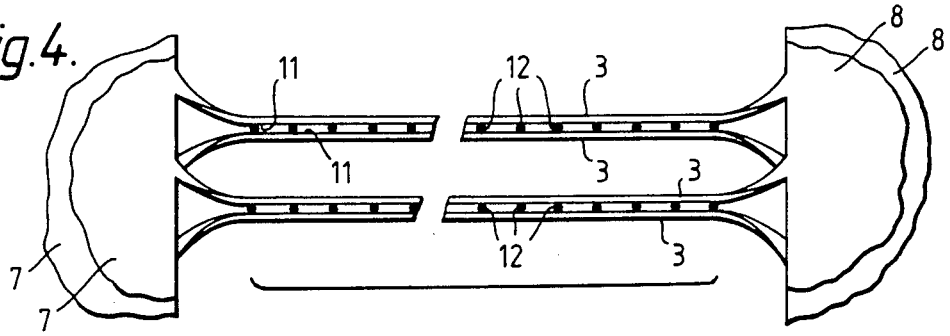
FIG. 4 is a plan view of the assembly shown in FIGS. 2 and 3 after the deflector electrodes have been rotated.
Figure 5A:
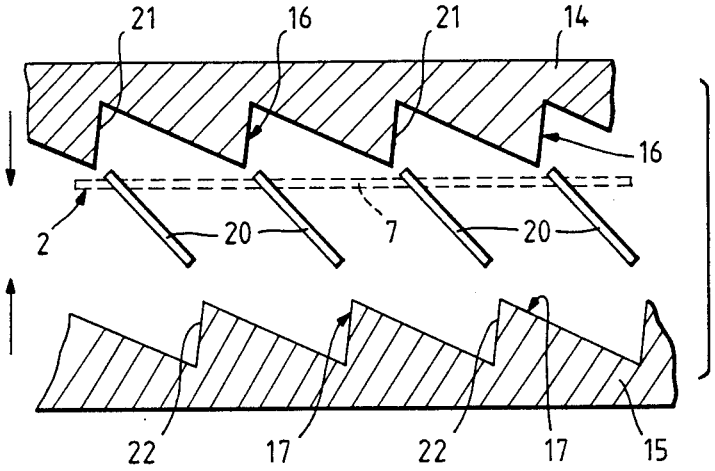
FIGS. 5*a* and 5*b* show schematically an arrangement for rotating the deflector electrodes.
Figure 5B:
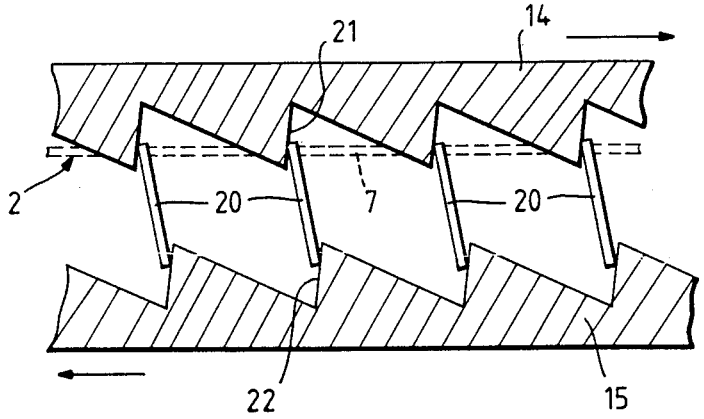

The tie-bars 6 were then removed by laser cutting in order that each pair of registered deflector electrodes 3 could be rotated through 90±5° as shown in FIG. 4. Rotation of the electrodes 3 was performed in two steps (FIGS. 5*a* and 5*b*). The margins and borders of the lower sheet 2 were supported in a clamping frame. For the sake of clarity, the strip portions of the sandwich are not shown and the bonded pairs of deflector electrodes are represented at 20. Two serrated tools 14 and 15 were positioned so that the sloping surfaces of their respective teeth 16 and 17 abutted the bonded pairs of deflector electrodes 20 from above and below (shown in FIG. 5*a*) respectively. The tool 14 was urged downwards and the tool 15 was urged upwards until the bonded pairs of deflector electrodes 20 had been rotated through approximately 45°, as determined by the sloping surfaces of the teeth. The tools 14 and 15 were then moved into a second position in which surfaces 21 of the tool 14 and surfaces 22 of the tool 15 abutted the upper and lower edge portions respectively of the electrodes 20, and the tools 14 and 15, as shown in FIG. 5*b*, were moved to the right and to the left respectively until the electrodes 20 had been rotated through 90±5° about respective axes parallel to and offset from the longitudinal axes of the respective pairs of electrodes 20. The colour-selection deflector electrode structure so produced was then ready for assembly in a colour picture display tube.

EXAMPLE 2

Figure 2:
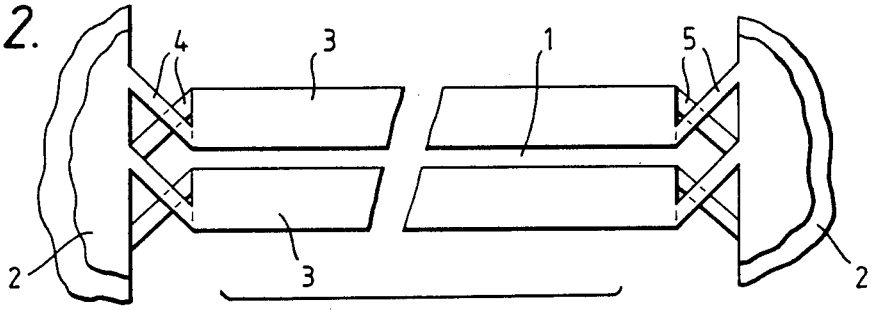
FIG. 2 is a plan view showing part of an assembly of two superposed metal sheets of the form shown in FIG. 1.
Figure 3:
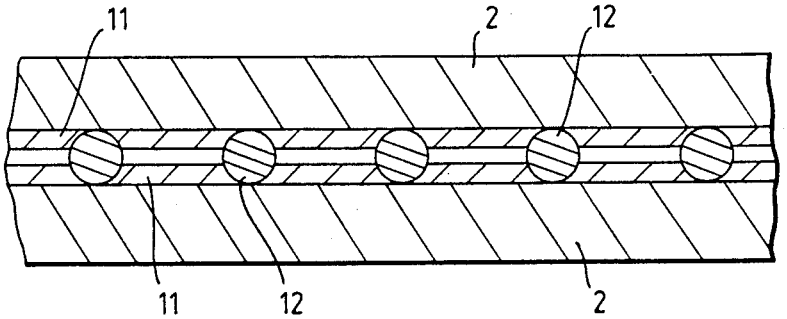
FIG. 3 is a side-sectional view through a marginal portion of the assembly shown in FIG. 2 in which the thickness has been greatly exaggerated for the sake of clarity.
Figure 6A:
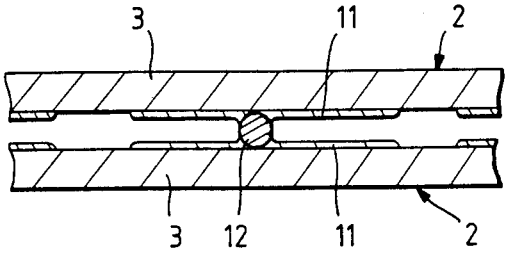
FIGS. 6*a*, 6*b* and 6*c* show steps in a second method of forming an assembly consisting of two spaced metal sheets in which deflector electrodes and strip portions are produced by etching.
Figure 6B:
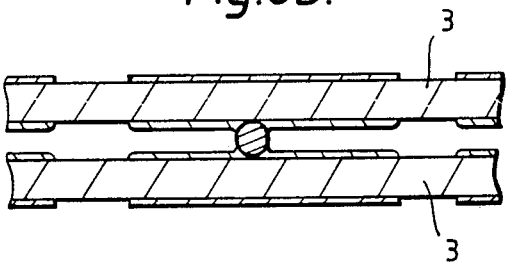
Figure 6C:
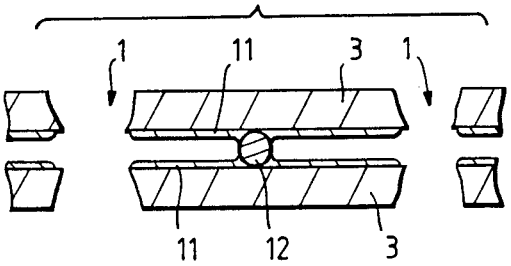

Referring to FIG. 6*a*, a sandwich of two unetched mild steel sheets 2 enclosing glass coatings 11 and ballotini 12 which serve as spacing elements, is prepared in a similar manner to the sandwich shown in FIG. 2 and described in Example 1. Patterned positive-working photoresist layers are formed on the exposed main surfaces of the steel sheets 2 by forming photoresist layers on the respective surfaces, exposing the layers patternwise so as to define a pattern corresponding to the pattern of slits 1 similar to those shown in FIG. 1 defining deflector electrodes, strip portions and margins but defining no tie-bars, and developing the exposed layers (FIG. 6*b*). The assembly so formed is then spray-etched with a ferric chloride solution so as to produce bonded pairs of deflection electrodes 3 isolated by slits 1 in the two steel sheets 2, and then the residual photoresist material is removed from the steel sheets 2 (FIG. 6*c*). A colour-selection deflection electrode structure similar to that shown in FIG. 4 is then formed by rotating the deflection electrodes through 90±5° by the method described in Example 1.

EXAMPLE 3

Figure 7A:
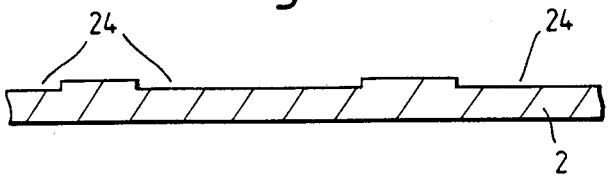
FIGS. 7*a*, 7*b*, 7*c* and 7*d* show steps in a method of producing an assembly similar to that shown in FIG. 6*a*, FIGS. 8*a* and 8*b* show steps in making an assembly in which grooves which define the outlines of deflector electrodes and strip portions have been etched.
Figure 7B:
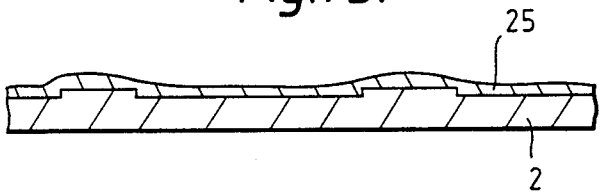
Figure 7C:
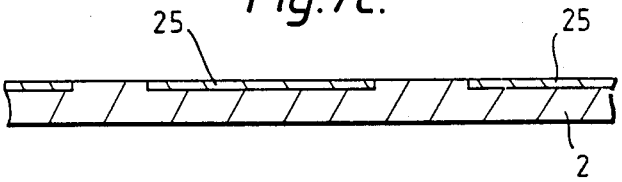
Figure 7D:
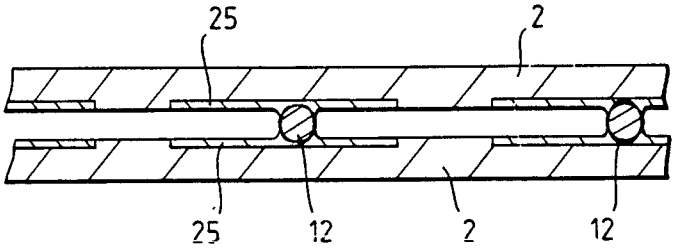

Referring to FIG. 7*a* channels 24 are etched in one main surface of each of two steel sheets 2, (only one of which is shown in FIGS. 7*a–c*) which channels 24 are around 20 μm deep and correspond to the areas of the sheets at which deflector electrodes 3 and sheet margins at to be present. The etched main surface of each sheet 2 is coated with a thickness of glass ink 25 which after drying has a greater thickness than the depth of the channels 24 (FIG. 7*b*). The excess dried glass ink is wiped off and adherent glass coatings are formed on the surfaces of the channels by firing the sheets (FIG. 7*c*). The two sheets 2 are then juxtaposed with the glass coatings 25 opposed to each other, spacing elements in the form of ballotini 12 being disposed between the opposed glass coatings. This assembly is heated to 490° C. and the two sheets 2 are urged towards each other until the distance between the two sheets is determined by the ballotini 12 (FIG. 7*d*). Slits are then etched in the two sheets at the regions between the channels 24 in order to define the deflector electrodes, strip portions and sheet margins, and the deflector electrodes are rotated, using the methods described in Examples 2 and 1 respectively.

EXAMPLE 4

Figure 8A:
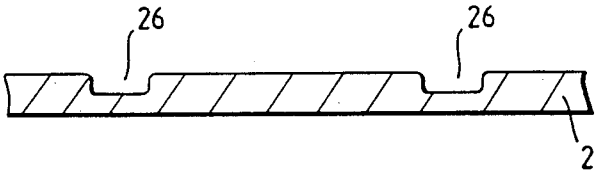
Figure 8B:
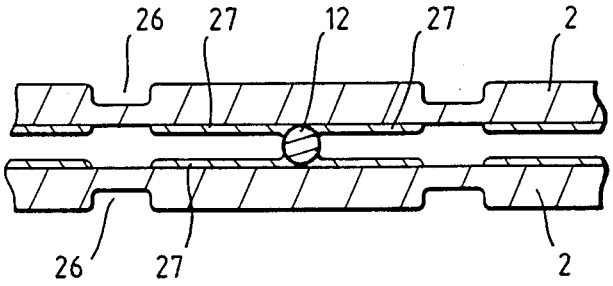

A pattern of grooves 26 which are around 50 μm deep and correspond to the pattern of slits 1 shown in FIG. 1 are etched in two 75 μm thick mild steel sheets 2 (FIG. 8*a*). The unetched main surfaces of these sheets are then provided with adherent glass coatings 27 and a sandwich of the coated sheets spaced by ballotini 12 is formed using a method similar to that described in Example 2 with reference to FIG. 6*a* to form the sandwich shown in FIG. 8*b*. The exposed main surfaces of the sheets 2 in the region of the grooves 26 are then etched completely through so as to form continuous slits. The deflector electrodes defined by these slits are then rotated using the method described in Example 1.

Mounting of deflection structure on extractor electrode of laminated dynode channel plate electron multiplier.

Figure 10:
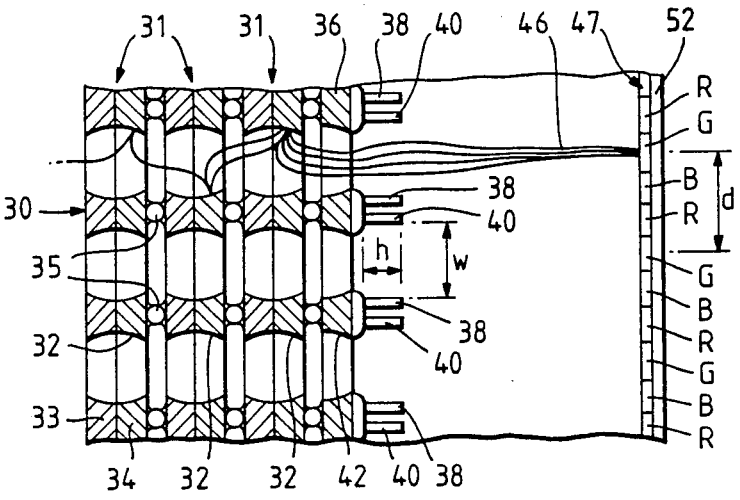
FIG. 10 is a sectional view, not to scale, viewed in the direction indicated by arrows A in FIG. 9, of a portion of the last three stages of a laminated dynode channel plate electron multiplier, an extractor electrode, a colour-selection deflection electrode structure made by a method according to the invention, a display screen and a face-plate.

A suitable laminated dynode channel plate electron multiplier 30 for use with a colour-selection deflection structure made in accordance with the present invention is disclosed in British patent specifications Nos. 1,434,053 and 2,023,332A. Accordingly reference may be had to these patent specifications for a detailed description of its construction and operation. However for the sake of completeness, the illustrated electron multiplier, 30, comprises a plurality of apertured dynodes 31 of which the last three are shown in FIG. 10. The barrel-shaped apertures 32 in successive dynodes are aligned with each other to form channels. The dynodes 31 in fact comprise two half dynodes 33, 34 arranged back to back. Successive dynodes 31 are separated from each other by a resistive or insulating spacing means which in the illustrated embodiments comprise glass ballotini 35. In operation the electron beam 45 entering a channel undergoes current multiplication by secondary emission as it passes from one dynode to the next, each of which is typically 300 V more positive than the previous one. In order to extract the current multiplied electron beams 46 from the final dynode of the electron multiplier 30, an extractor electrode 36 is provided. This extractor electrode 36 generally comprises a half dynode mounted on, but spaced from, the final dynode. A positive voltage, typically +60 V relative to that of the last dynode, is applied to the extractor electrode 36 which not only draws out the electron beam 46 but also focuses it.

With the illustrated arrangement of the phosphors R, G and B in the repeating groups comprising screen 47 on faceplate 52, an undeflected, current multiplied electron beam 46 will impinge on the green phosphor G. To impinge on the red, R, and blue, B, phosphors the electron beam 34 has to be deflected to the left and to the right, respectively. In the illustrated embodiment the deflection of the current multiplied electron beam 46 is achieved by pairs of deflector electrodes 38, 40 arranged one on each side of an aperture 42 in the extractor electrode 36. The deflector electrodes 38, 40 are mounted on, and spaced away from, the extractor electrode 36 by means of an insulating bond, e.g. glass enamel together with ballotini. All the electrodes 38 are interconnected as are the electrodes 40. The electrodes 38, 40 are electrically insulated from the extractor electrode 36. These electrodes 38, 40 also have to be fairly deep to be effective, typically for an embodiment having circular apertures 42 the height h should be more than w/2, w being the distance between the electrodes 38, 40 associated with a particular aperture 42, and a typical value for h is 0.37 mm. The deflector electrodes 38, 40 act as part of the lens system which forms an electron beam 46 of the required size. The electrodes 38, 40 produce a quadrupole field which reduces the size of the spot on the screen in the x or lateral direction whilst increasing it in the y or vertical direction. Whilst increasing the depth h of the electrodes 38, 40 decreases the spot size and reduces the deflection voltage required, there is a corresponding increase in the capacitance between the two sets of deflector electrodes. An upper limit to the depth h is set by the onset of beam broadening due to spurious secondary electrons produced at the extractor electrode 36 being able to reach the screen 47 since, for deeper deflector electrodes 38, 40, the mean deflector voltage for optimum beam focusing tends to be equal to or somewhat more positive than, the extractor electrode 36 voltage. A deflection electrode structure comprising electrodes of this depth cannot be readily made by the various deposition or printing techniques. However, the method according to the invention produces a colour-selection deflector electrode structure in which the deflector electrodes have the required depth, up to a maximum equal to the pitch minus the minimum etchable slot width.

In a non-illustrated variant of the arrangment shown in FIG. 10, the channel plate electron multiplier is a glass matrix electron multiplier having a plurality of channels extending between opposite input and output surfaces. The channels have a typical diameter of 12 microns and are at a typical pitch of 15 microns. An extractor electrode 36 and deflector electrodes 38, 40 are mounted on an output surface of the electron multiplier. Although there will be an inevitable loss of resolution in the displayed coloured image compared to a monochrome image, the inherent high resolution of a glass matrix channel plate will enable an acceptable coloured image to be produced for certain applications.

Figure 9:
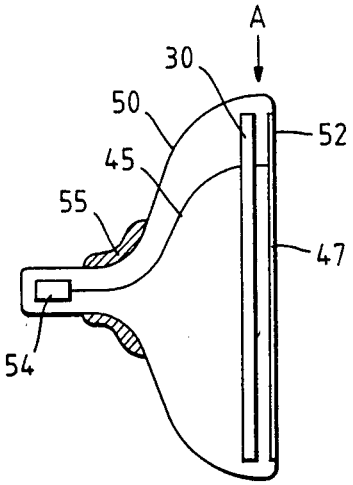
FIG. 9 is a diagrammatic side-sectional elevation of a colour picture display tube comprising a channel plate electron multiplier and a colour-selection deflection electrode structure made by a method according to the invention.

Referring to FIG. 9, a colour picture display tube comprises an envelope 50 with a substantially flat faceplate 52 bearing a display screen 47. A channel plate electron multiplier 30 is arranged parallel to, but spaced from, the screen 47. The electron multiplier 30 may be a laminated metal dynode multiplier or a glass matrix multiplier. A device for producing a low energy electron beam 18, for example, an electron gun 54, is disposed in a neck of the envelope 50. The electron beam 45 is scanned across the input face of the electron multiplier 30 by deflection means 55 mounted on the tube neck. The colour picture display tube may alternatively be of the flat kind described generally in published British Patent Specification No. 2101396 corresponding to U.S. patent application Ser. No. 830,388, filed Feb. 14, 1986. Indeed, because colour selection is independent of beam scanning, the electron beam colour selection deflector arrangement described above may be used in any type of tube employing a channel plate electron multiplier where the input conditions to the multiplier are separated from those of the output.

We claim:

1. A method of making a color-selection deflection structure for a color picture display tube which includes a channel plate electron multiplier provided with an extractor electrode mounted on, and electrically insulated from, the output face of the electron multiplier, the method comprising the steps of forming a plurality of parallel slits in each of a pair of metal sheets, each slit extending between opposite margins of the respective sheet, wherein each pair of adjacent slits in a respective metal sheet defines an elongate rectangular deflector electrode and strip portions which extend one from each end to the adjacent margin of the metal sheet, applying a glass to at least one of the metal sheets on a major surface of the deflector electrodes and of the margins of the metal sheet, heating the metal sheet(s) bearing the glass so as to produce an adherent coating of glass on the deflector electrodes and sheet margins, rotating the deflector electrodes on each sheet through 90±5° about axes parallel to and offset from the longitudinal axis of the respective deflector electrode, juxtaposing the two sheets so that the deflector electrodes of one sheet are in registration with the deflector electrodes of the other metal sheet, forming an integral assembly by heating the pair of juxtaposed metal sheets so as to soften the glass and urging the registered pairs of deflector electrodes and opposed sheet margins respectively towards each other, wherein the spacing between the opposed deflector electrodes and between the opposed sheet margins is determined by spacing elements provided between the said deflector electrodes and between the said sheet margins, wherein the spacer elements have a softening point above the temperature to which the juxtaposed metal sheets were heated during the formation of the integral assembly.

2. A method as claimed in claim 1, wherein a first metal sheet provided with the slits is superposed on a second metal sheet provided with the slits, the deflector electrodes of the two sheets being in registration and being separated only by spacer elements disposed between the opposed deflector electrodes and between the opposed sheet margins and the glass, the opposed deflector electrodes and the opposed sheet margins are respectively bonded together by heating the pair of sheets so as to soften the glass and urging the two metal sheets towards each other until the separation between the opposed deflector electrodes and between the opposed sheet margins is determined by the spacing elements, the assembly is cooled, and the pairs of opposed deflector electrodes are rotated through 90±5° about respective axes which are parallel to and offset from the longitudinal axes of the respective pair of deflector electrodes.

3. A method as claimed in claim 2, wherein the slits of the two metal sheets are interrupted by tie bars which interconnect adjacent deflector electrodes, and wherein the tie bars are removed after the opposed deflector electrodes and the opposed sheet margins respectively have been bonded together and before the pairs of deflector electrodes have been rotated.

4. A method as claimed in claim 2, wherein each elongate rectangular deflector electrode is supported at its ends by respective first and second strip portions of the metal sheet, wherein first ends of the strip portions merge one each into respective ends of the deflector electrode and are situated between the longitudinal axis of the deflector electrode and a first border of the sheet and the second ends of the strip portions merge into respective opposite margins of the metal sheet, wherein the said first and second strip portions are substantially symmetrically disposed with respect to the deflector electrode longitudinal axis, and wherein the said first end of one metal sheet of the superposed pair is remote from the said first end of the other metal sheet.

5. A method as claimed in claim 4, wherein rotation of the pairs of deflector electrodes is commenced by increasing the separation in the planes of the metal sheets between the margins of the metal sheets which merge with the strip portions.

6. A method as claimed in claim 1, wherein the spacing elements are glass fibres or ballotini.

7. A method as claimed in claim 1, wherein the metal sheets consist of mild steel and are from 0.05 to 0.2 mm

8. A colour picture display tube including a colour selection deflection electrode structure manufactured in accordance with claim 1.

9. A method of making a colour-selection deflection structure for a colour picture display tube which includes a channel plate electron multiplier provided with an extractor electrode mounted on, and electrically insulated from, the output face of the electron multiplier, the method comprising the steps of providing one main surface of at least one of a pair of metal sheets with an adherent glass coating in a pattern corresponding substantially to the positions of a plurality of parallel rectangular elongate deflector electrodes connected to margins of the sheet by strip portions, which deflector electrodes and strip portions are subsequently to be produced by selectively etching that metal sheet, assembling the pair of metal sheets to form a sandwich in which the glass coating and spacing elements are disposed between the metal sheets, heating the sandwich so as to soften the glass coating and urging the metal sheets towards each other so as to form a unitary assembly in which the distance between the metal sheets is defined by the spacing elements, providing photoresist masks on the two metal sheets, the apertures in which masks define the deflector electrodes and the strip portions to be formed in each metal sheet, the masks being disposed so that the deflector electrodes of one metal sheet are in registration with the deflector electrodes of the other metal sheet, etching the metal sheets through the masks so as to produce the deflector electrodes and strip portions, and rotating each pair of opposed deflector electrodes through 90±5° about a respective axis which is parallel to and offset from the longitudinal axes of the respective pair of deflector electrodes.

10. A method as claimed in claim 9, wherein the patterned adherent glass coating is formed on each metal sheet by etching a Pattern of channels which correspond to the positions of the deflector electrodes and of the margins of the sheet in one main surface of each metal sheet, filling the channels with glass by applying glass powder to the etched main surface of each metal sheet, removing the glass powder standing proud of the channels and also the glass powder present on the unetched areas of the main surface of each metal sheet, and heating each metal sheet so as to form the adherent patterned glass coating on the respective metal sheet.

11. A method as claimed in claim 9, wherein one main surface of each metal sheet is pre-etched through more than 50% of their thickness in accordance with a pattern which defines the outlines of the deflection electrodes and the strip portions, and then the adherent glass coating is formed on the other main surface of one or both of the metal sheets.

12. A color picture display tube comprising an envelope having an optically transparent faceplate, a cathodoluminescent screen contiguous with the internal surface of the faceplate, an apertured channel plate electron multiplier mounted adjacent to, but spaced from, the screen, an extractor electrode mounted on, and insulated from, an output face of the electron multiplier, a color selection deflection structure mounted over, and insulated from, the extractor electrode, said structure comprising pairs of opposed electrodes, said deflector electrodes being insulated from each other by spacer elements, the pairs of opposed deflector electrodes comprising contiguous strip portions of juxtaposed metal sheets which are separated from each other by the spacer elements, which strip portions have been rotated about their ends so as to be at $90° \pm 5°$ to the plane of their respective sheets.

13. A colour picture display tube as claimed in claim 12, wherein the channel plate electron multiplier is an apertured metal dynode channel plate electron multiplier and wherein the apertures in the electron multiplier and apertures in the extractor electrode are arranged rectilinearly, the pairs of opposed electrodes being disposed between the rectilinearly arranged apertures in the extractor electrode.

* * * * *